US006957558B1

(12) United States Patent
Chuang

(10) Patent No.: US 6,957,558 B1
(45) Date of Patent: Oct. 25, 2005

(54) ENCAUSTIC METAL TILE FABRICATION EQUIPMENT

(76) Inventor: Sen-Jung Chuang, No. 90-10, Hsia Kwei Jou San, Tan Shui Chen, Taipei Hsien (TW)

( * ) Notice: Subject to any disclaimer, the term of this patent is extended or adjusted under 35 U.S.C. 154(b) by 2 days.

(21) Appl. No.: 10/843,326

(22) Filed: May 12, 2004

(51) Int. Cl.[7] ..... B21D 13/10
(52) U.S. Cl. ..... 72/130; 72/177; 72/307; 72/311; 72/379.6; 72/385
(58) Field of Search ..... 72/307, 311, 308, 72/309, 301, 385, 386, 379.6, 177, 130

(56) References Cited

U.S. PATENT DOCUMENTS 4,250,728 A * 2/1981 King ..... 72/177
4,444,037 A * 4/1984 Norgate ..... 72/177
4,528,835 A * 7/1985 Ekmark ..... 72/301
6,192,731 B1 * 2/2001 Toivanen ..... 72/307
6,497,131 B1 * 12/2002 Feijen ..... 72/297

* cited by examiner

*Primary Examiner*—Daniel C. Crane
(74) *Attorney, Agent, or Firm*—Troxell Law Office, PLLC

(57) ABSTRACT

An encaustic metal tile fabrication equipment includes a roller unit operated to roll an encaustic metal sheet into a corrugated encaustic metal sheet, a shape forming mechanism having a first shape forming mold unit and a second shape forming mold unit and operated to process the corrugated encaustic metal sheet into an encaustic metal tile having a bend with a recessed portion, and a cutting unit operated to cut the finished encaustic metal tile to the desired size.

1 Claim, 11 Drawing Sheets

ENCAUSTIC METAL TILE FABRICATION EQUIPMENT

BACKGROUND AND SUMMARY OF THE INVENTION

The present invention relates to an encaustic metal tile fabrication equipment, and more particularly to such an encaustic metal tile fabrication equipment which automatically fabricates encaustic metal tiles without causing a damage to the coating of the finished metal tiles.

Conventionally, an encaustic metal tile 11 is made by: roller ramming an encaustic metal sheet into a corrugated encaustic metal sheet, then operating the upper die and bottom die of a press to stamp the corrugated encaustic metal sheet into an encaustic metal tile having bends, and then cutting the finished encaustic metal tiles to the desired size. When the corrugated encaustic metal sheet is stamped into an encaustic metal tile having bends, the coating of the corrugated encaustic metal sheet tends to be damaged.

The present invention provides an encaustic metal tile fabrication equipment which eliminates the aforesaid problems. According to the present invention, the encaustic metal tile fabrication equipment comprises a roller unit operated to roll an encaustic metal sheet into a corrugated encaustic metal sheet, a shaped forming mechanism having a first shape forming mold unit and a second shaped forming mold unit and operated to process the corrugated encaustic metal sheet into an encaustic metal tile having a bend with a recessed portion, and a cutting unit operated to cut the finished encaustic metal tile to the desired size. The first shaped forming mold unit is operated to process a part of the corrugated encaustic metal sheet into a curved face. The curved face is then processed by the second shape forming mold unit into a bend having a recessed portion. This processing procedure does not damage the coating of the corrugated encaustic metal sheet.

DETAILED DESCRIPTION OF THE INVENTION

Figure 1:
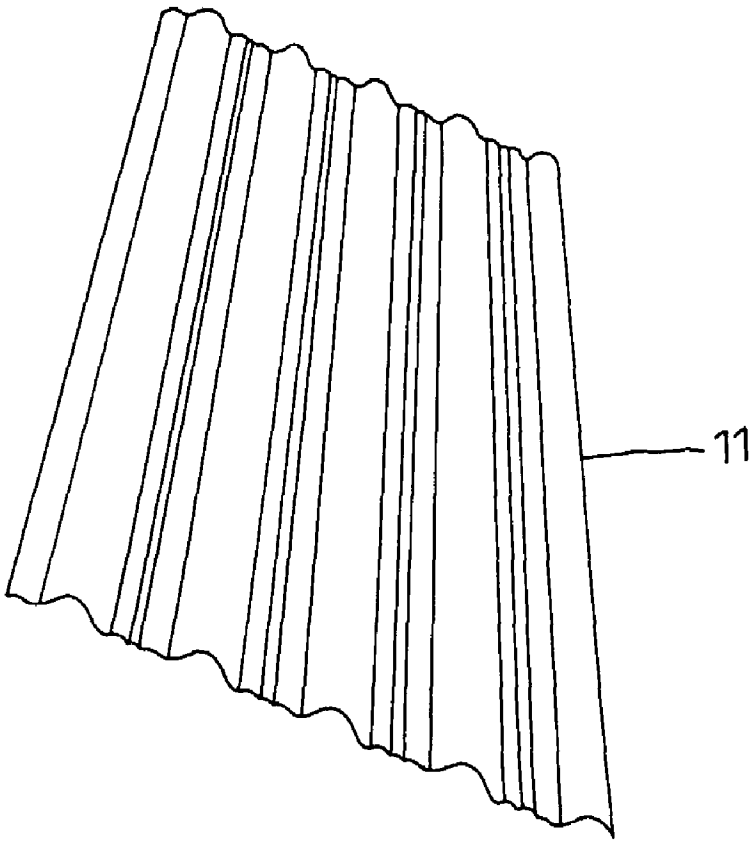
Fig. 1 PRIOR ART
FIG. 1 illustrates a corrugated encaustic metal sheet processed through a roller ramming machine according to the prior art.
Figure 3:
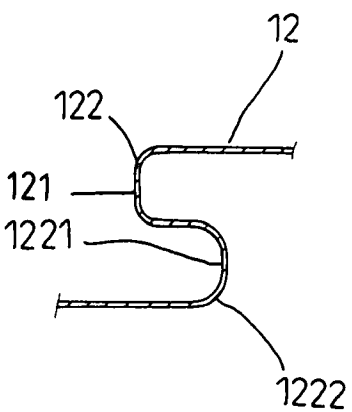
FIG. 3 is a sectional view of an encaustic metal tile according to the present invention.
Figure 2:
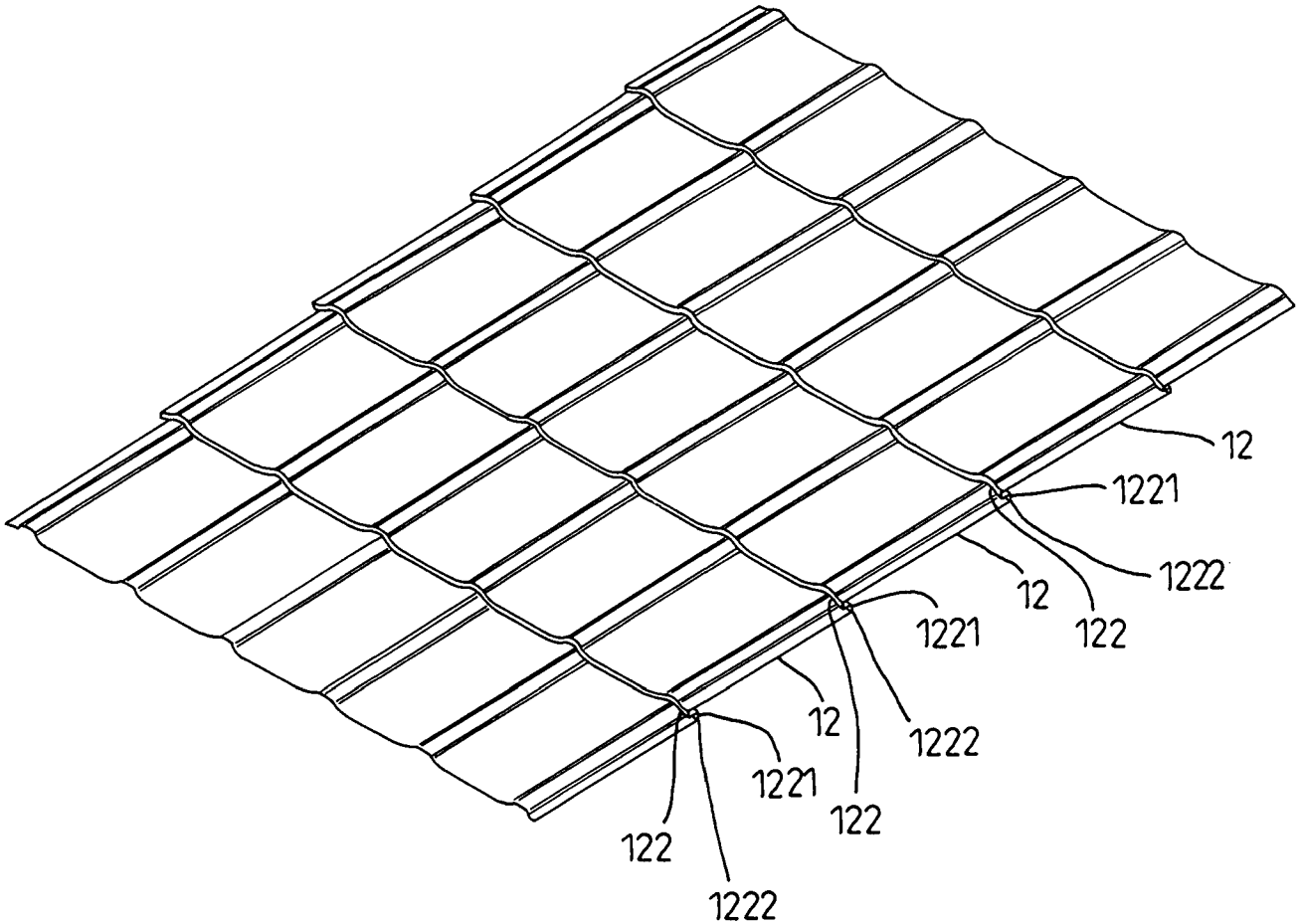
FIG. 2 illustrates a plurality of encaustic metal tiles arrangement together according to the present invention.
Figure 4:
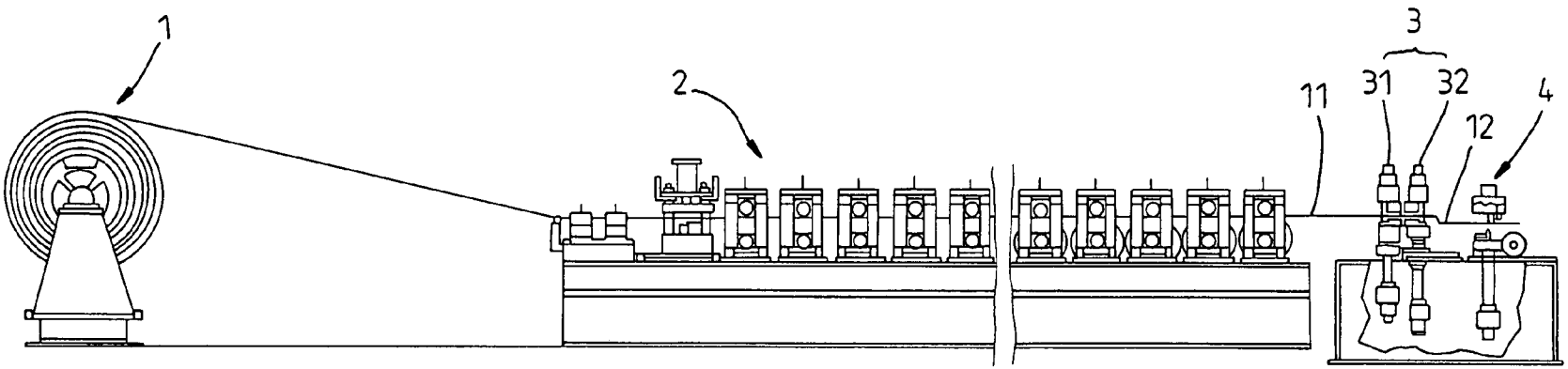
FIG. 4 is a side view of an encaustic metal tile fabrication equipment according to the present invention.
Figure 5:
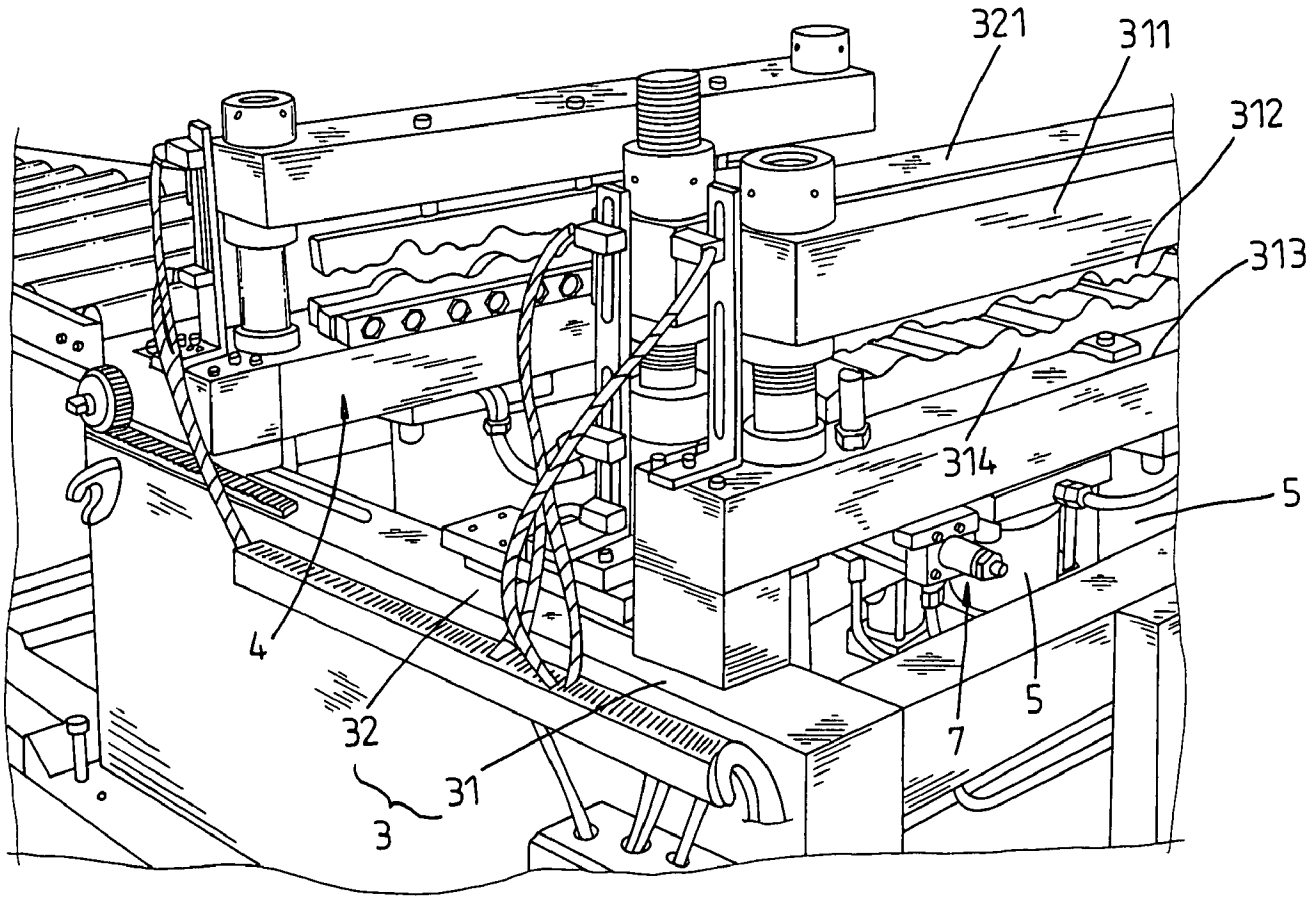
FIG. 5 is a perspective view in an enlarged scale of a part of the encaustic metal tile fabrication equipment shown in FIG. 4.
Figure 6:
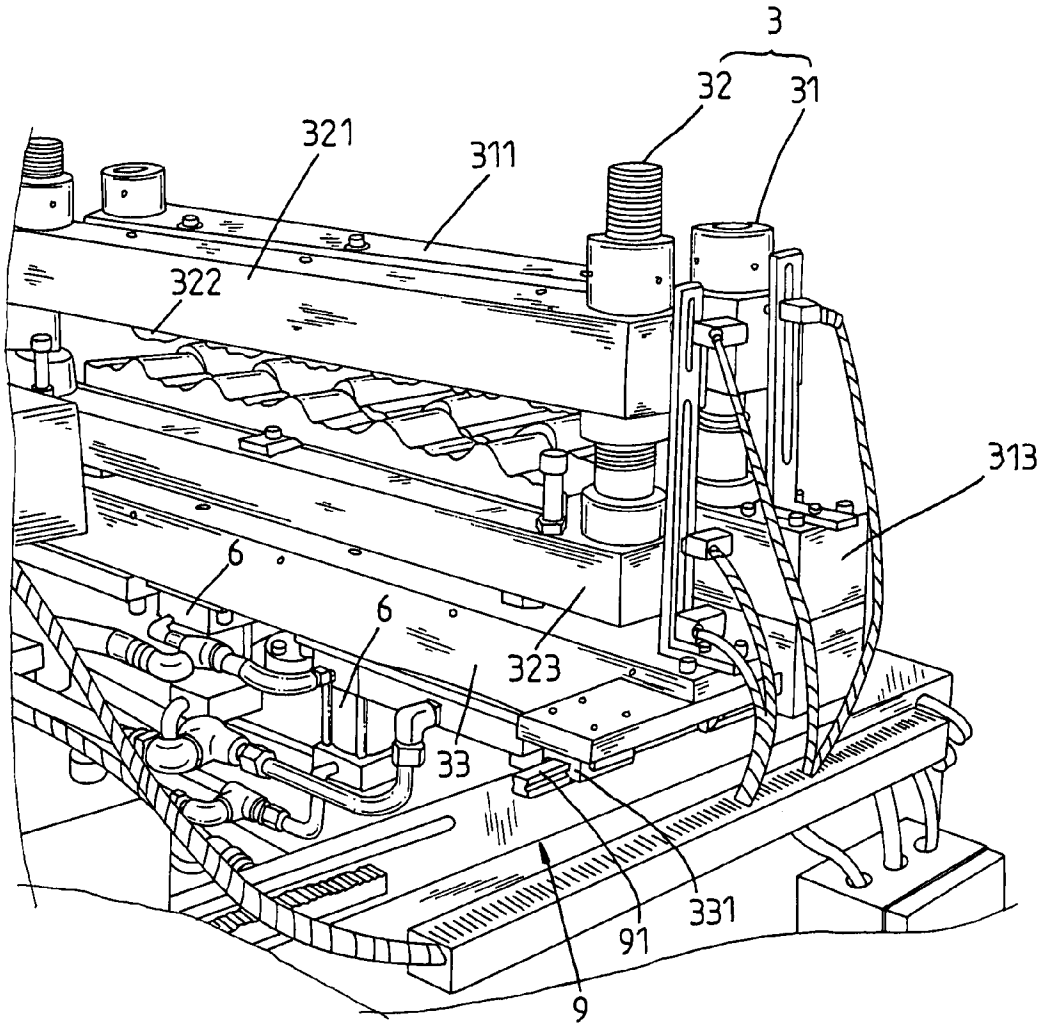
FIG. 6 is another perspective view of the present invention when viewed from another angle.

Referring to FIGS. 2 through 12, an encaustic metal sheet 1 is processed through a roller unit 2 into a corrugated encaustic metal sheet 11, then processed through a first shape forming mold unit 31 and second shape forming mold unit 32 of a shape forming mechanism 3 into encaustic metal tiles 12, and then cut to the desired length through a cutting unit 4.

Referring to FIGS. 4, 5, 6, 11 and 12, the first shape forming mold unit 31 is disposed behind the roller unit 2, comprised of an upper die holder 311 an upper die 312 fixedly fastened to the upper die holder 31, a bottom die holder 313, and a bottom die 314 fixedly fastened to the bottom die holder 313. The upper die holder 311 is reciprocated vertically by hydraulic cylinders 6 relative to the bottom die holder 313. When the corrugated encaustic metal sheet 1 is inserted into the space between the bottom die 314 and the upper die 312, the upper die holder 311 is lowered to press the upper die 312 on the corrugated encaustic metal sheet 1 against the bottom die 314, thereby causing the corrugated encaustic metal sheet 1 to be stamped into shape.

The second shape forming mold unit 32 is disposed adjacent to the first shape forming mold unit 31. Hydraulic cylinders 7 are horizontally disposed below the bottom die holder 313, each having a piston rod 71 respectively connected to a horizontal slide 33. The second shape forming mold unit 32 is mounted on the horizontal slide 33. When the hydraulic cylinders 7 are operated, the horizontal slide 33 is moved forwards/backwards with the piston rods 71, and therefore the distance between the second shape forming mold unit 32 and the first shape forming mold unit 31 is relatively adjusted. The hydraulic cylinders 5 are fixedly vertically fastened to the bottom die holder 313 at the bottom side, each having a piston rod 51 fixedly connected to a transverse bar 318. Links 315 and 316 are bilaterally coupled between the transverse bar 318 and the upper die holder 311. When the hydraulic cylinders 5 are operated, the upper die holder 311 is moved vertically upwards or downwards.

The horizontal slide 33 which carries the second shape forming mold unit 32 comprises two sliding grooves 331 longitudinally arranged in parallel at its bottom side wall and coupled to parallel rails 91 at the top side of the machine base 9. The horizontal slide 33 is connected to the front ends of the piston rods 71 of the hydraulic cylinders 7. when the hydraulic cylinders 7 are operated, the horizontal slide 33 is moved along the rails 91, causing the bottom die holder 323, which holds a bottom die 324, and upper die holder 321, which holds an upper die 322, of the second shape forming mold unit 32 to be moved with the horizontal slide 33 relative to the first shape forming mold unit 31. The hydraulic cylinders 6 are respectively mounted on the horizontal slide 33, each having a vertically extended piston rod 61 respectively connected to a horizontal bar 328. Two links 325 and 326 are coupled between the transverse bar 328 and the bottom die holder 323 of the second shape forming mold unit 32. Hydraulic cylinders 8 are fixedly mounted on the horizontal slide 33 at the bottom side, and operated to move the bottom die holder 323 of the second shape forming mold unit 32 vertically.

Figure 7:
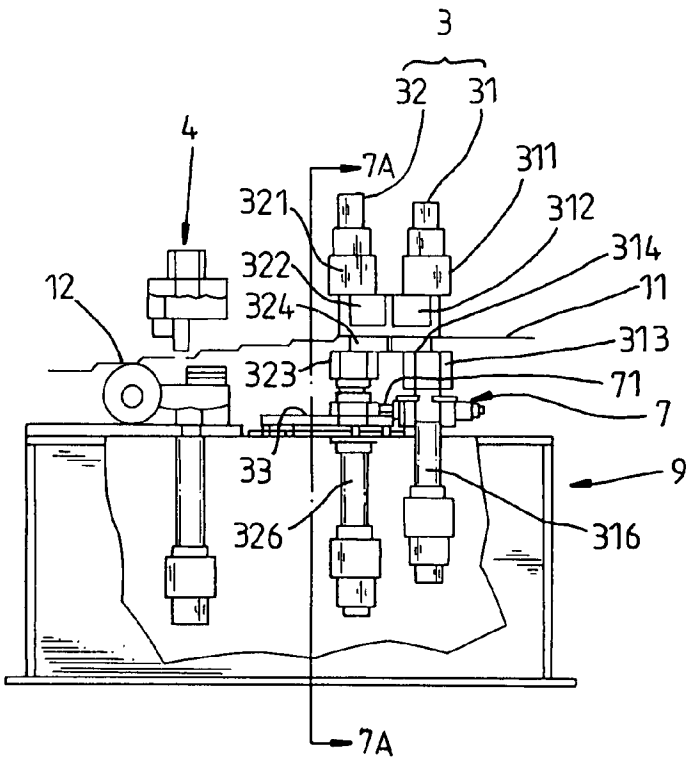
FIG. 7 is a side view of the present invention before the insertion of the corrugated encaustic metal sheet into the first shape forming mold unit and the second shape forming mold unit.
Figure 7A:
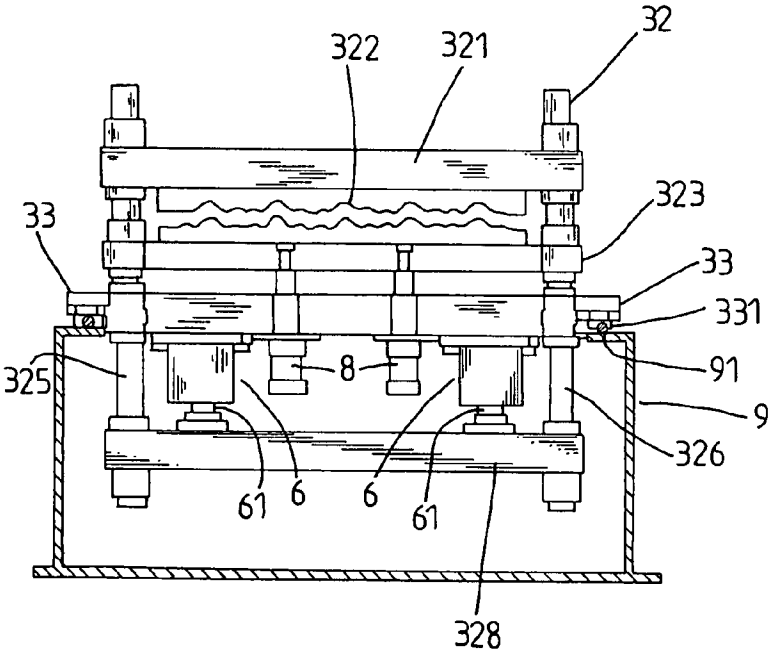
FIG. 7A is a sectional view taken along line 7A—7A of FIG. 7.
Figure 8:
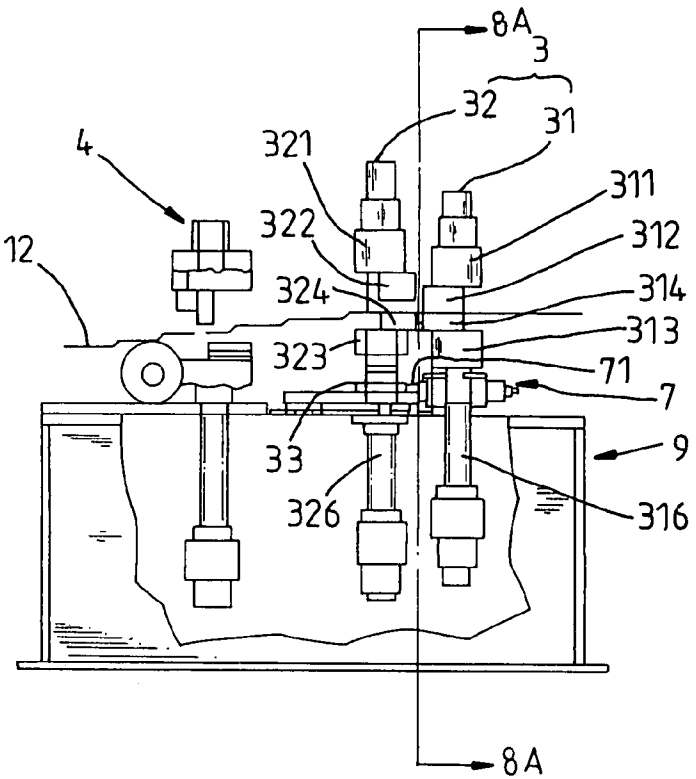
FIG. 8 is similar to FIG. 7 but showing the upper die of the first shape forming mold unit pressed on the corrugated encaustic metal sheet against the respective bottom die.
Figure 8A:
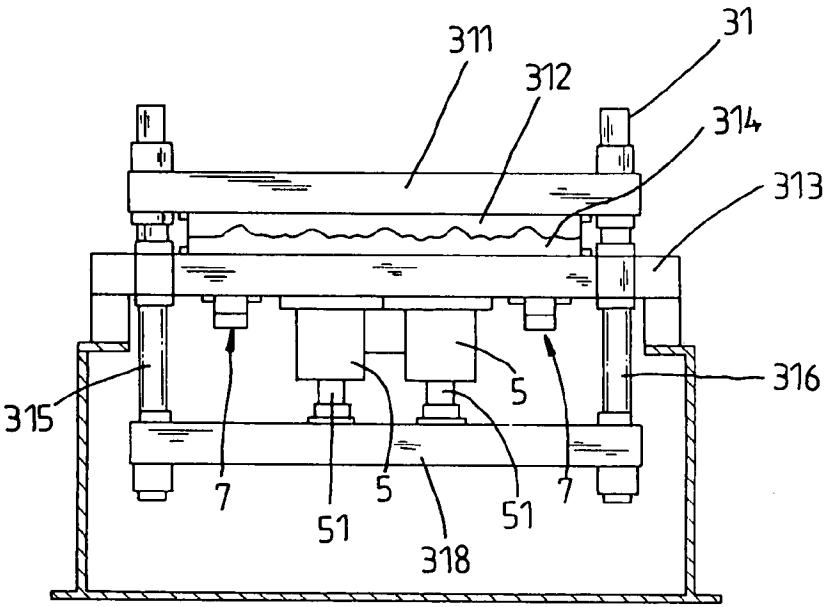
FIG. 8A is a sectional view taken along line 8A—8A of FIG. 8.
Figure 9:
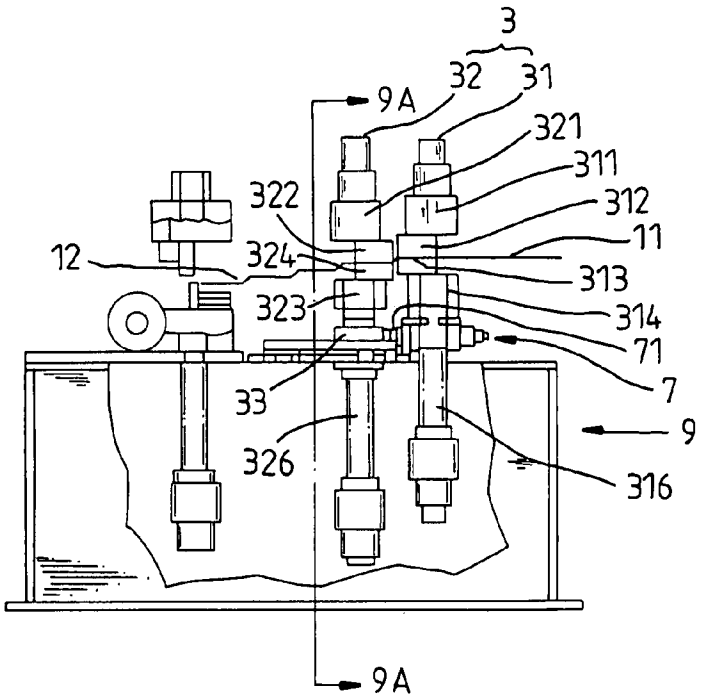
FIG. 9 is similar to FIG. 8 but showing the upper die and bottom die of the second shape forming mold unit operated, a curved face formed at the corrugated encaustic metal sheet.
Figure 9A:
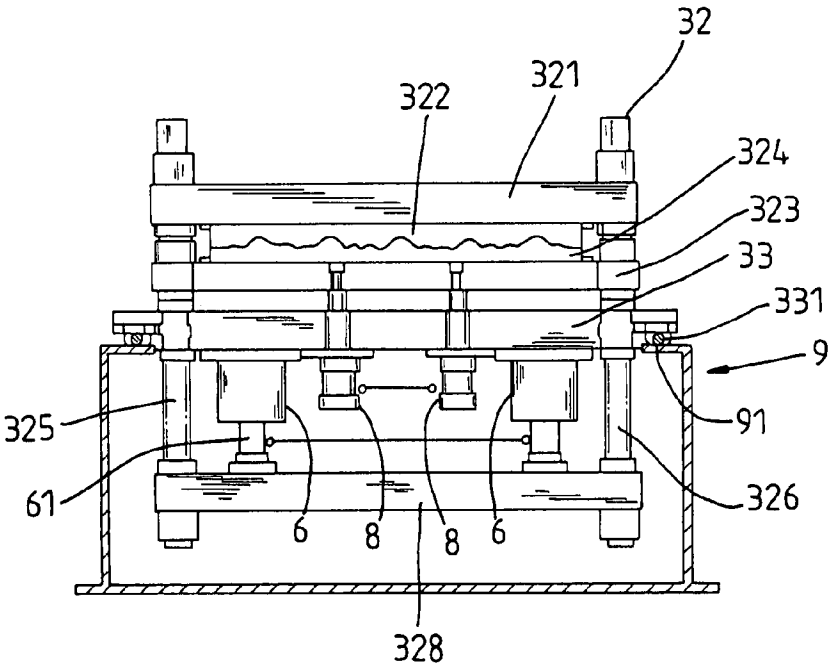
FIG. 9A is a sectional view taken along line 9A—9A of FIG. 9.
Figure 10:
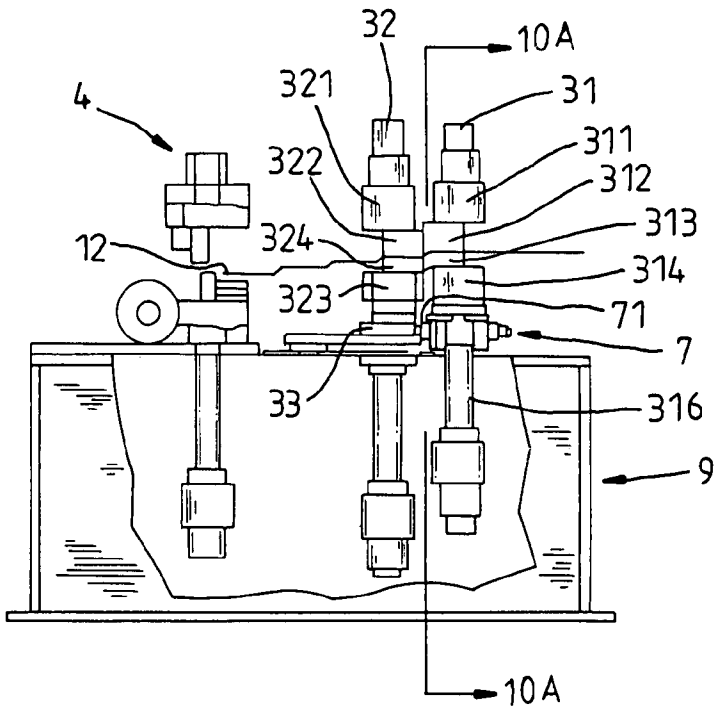
FIG. 10 is similar to FIG. 9 but showing the upper die and bottom die of the second shape forming mold unit moved toward the upper die and bottom die of the first shape forming mold unit, a bend formed at the curved face of the corrugated encaustic metal sheet.
Figure 10A:
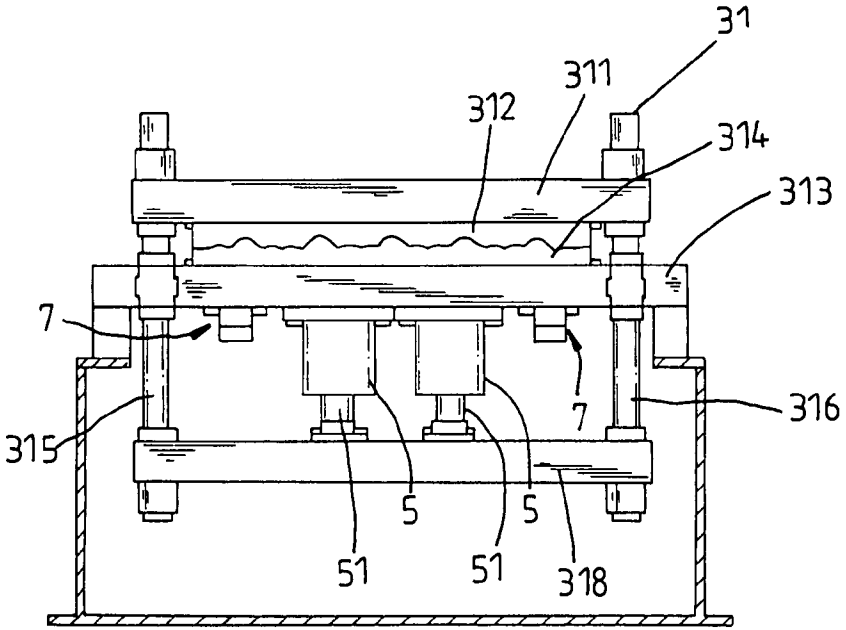
FIG. 10A is a sectional view taken along line 10A—10A of FIG. 10.
Figure 11:
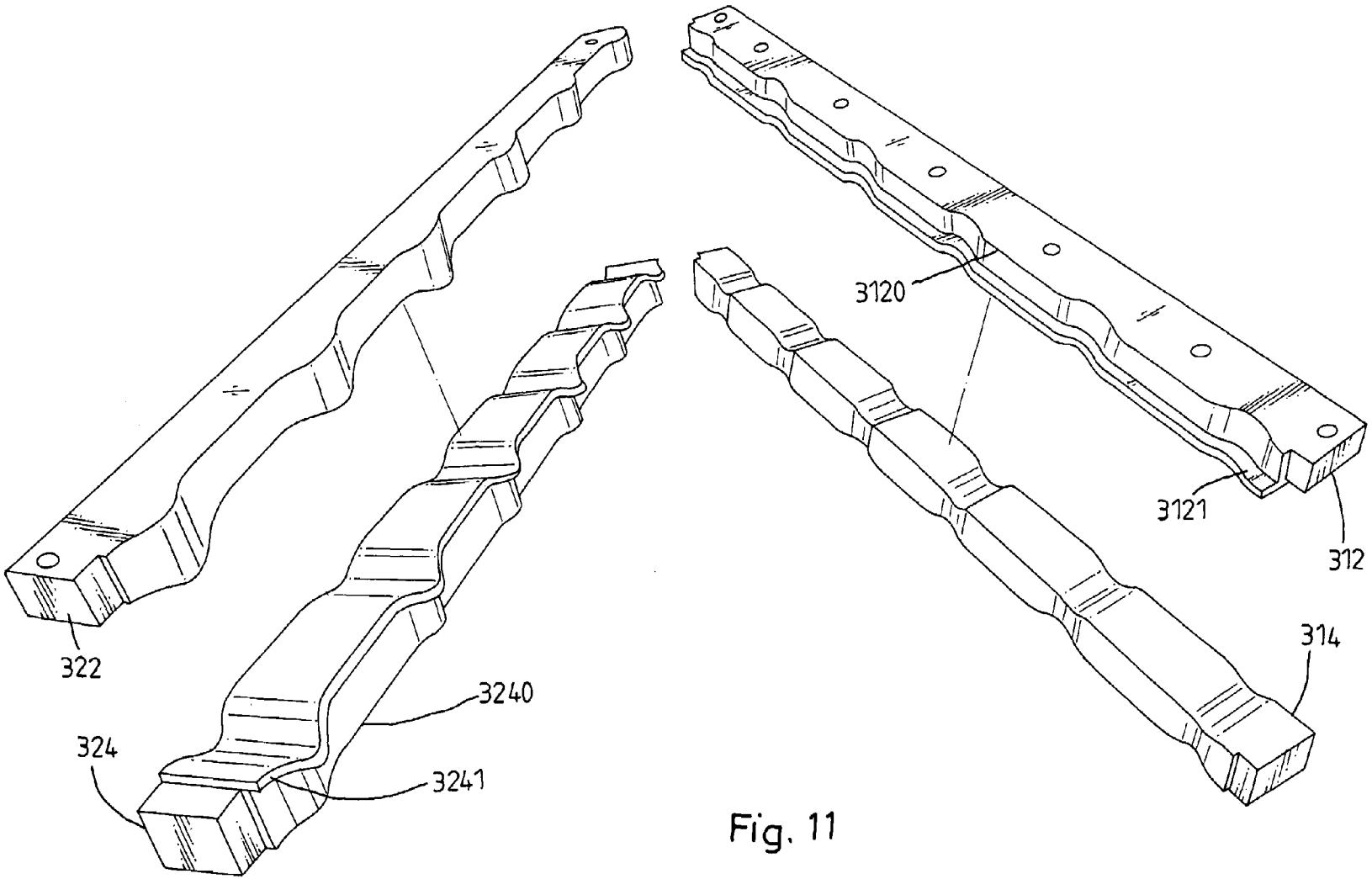
FIG. 11 is an exploded view of the upper die and bottom die of the first shape forming mold unit and the upper die and bottom die of the second shape forming mold unit according to the present invention.
Figure 12:
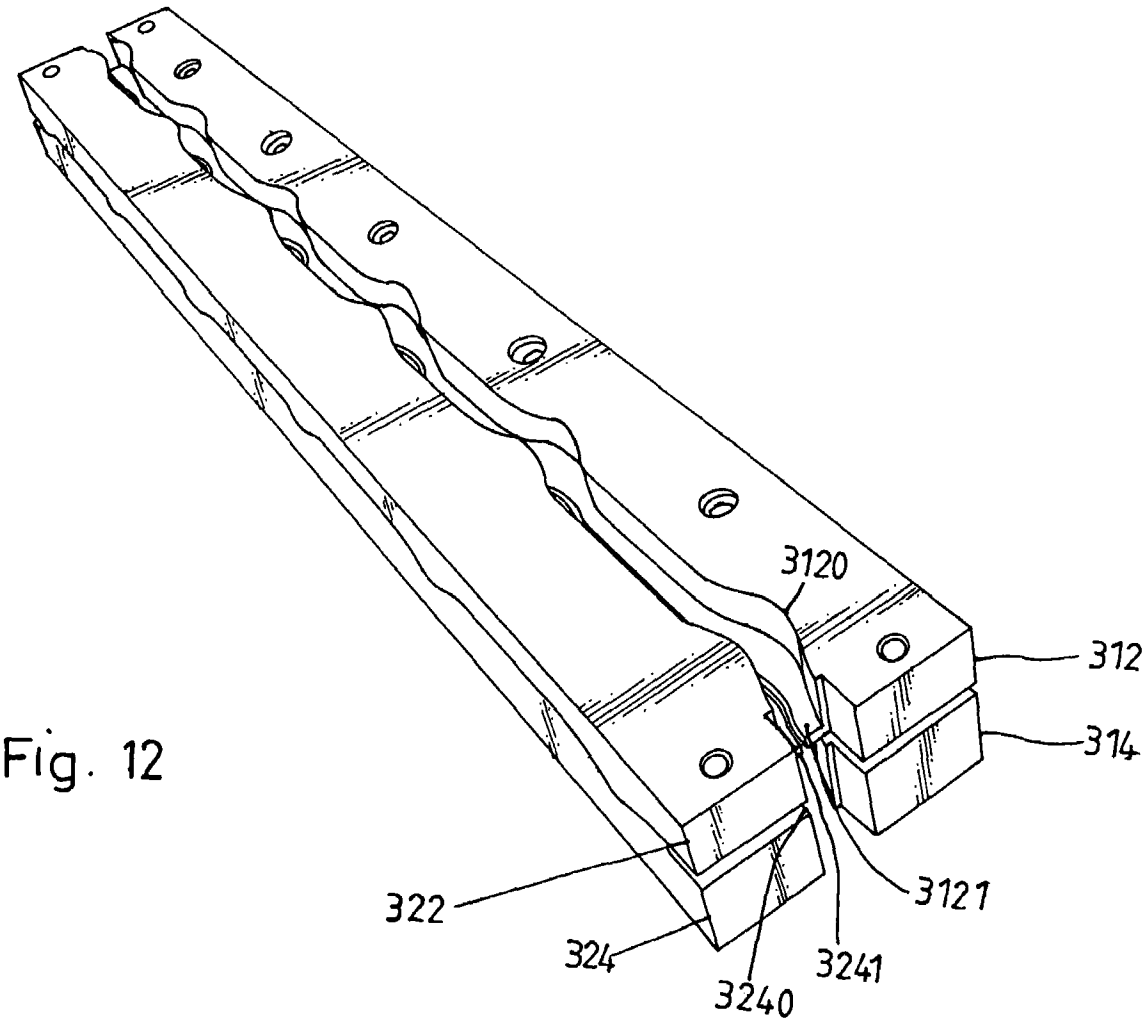
FIG. 12 is a perspective view of the upper die and bottom die of the first shape forming mold unit and the upper die and bottom die of the second shape forming mold unit according to the present invention.

When the corrugated encaustic metal sheet 11 is inserted in between the upper die holder 311 and bottom die holder 313 of the first shape forming mold unit 31 and the upper die holder 321 and bottom die holder 323 of the second shape forming mold unit 32 (see FIGS. 7, 7A and 11), the hydraulic cylinders 5 are operated to lower the upper die holder 311 of the first shape forming mold unit 31, causing the upper die 312 to be pressed on the corrugated encaustic metal sheet 11 against the bottom die 314 of the first shape forming mold unit 31 (see FIGS. 8, 8A and 11), then the hydraulic cylinders 6 and 8 are operated to move the upper die holder 321 and the bottom die holder 323, causing a part of the corrugated encaustic metal sheet 11 to be stamped by the upper die 322 and bottom die 324 of the second shape forming mold unit 32 into curved face 121, and then the hydraulic cylinders 7 are operated to move the horizontal slide 33 toward the first shape forming mold unit 31, causing the curved face 121 to be carried with the upper die 322 and bottom die 324 of the second shape forming mold unit 32 toward the upper die 312 and bottom die 314 of the first shape fo4rming mold unit 31 (see FIGS. 10 and 10A), and therefore a bend 122 is formed at the curved face 121.

The upper die 312 of the first shape forming mold unit 31 comprises a protruded rib 3121 raised along the bottom side of the vertical front side wall 3120 thereof. The bottom die 324 of the second shape forming mold unit 32 comprises a protruded rib 3241 raised along the top side of the vertical back side wall 3240 thereof. When the corrugated encaustic metal sheet 11 is carried with the upper die 322 and bottom die 324 of the second shape forming mold unit 32 towards the upper die 312 and bottom die 314 of the first shape forming mold unit 31, the curved face 121 of the corrugated encaustic metal sheet 11 is processed into a bend 122 having a recessed portion 1221. Because the bend 122 has a recessed portion 1221, the bending line 1222 at the bottom side of the bend 122 is kept from sight when encaustic metal tiles are arranged together on the roof of a building (see FIGS. 2 and 3).

What is claimed is:

1. An encaustic metal tile fabrication equipment comprising a roller unit operated to roll an encaustic metal sheet into a corrugated encaustic metal sheet, a shape forming mechanism having a first shape forming mold unit and a second shape forming mold unit and operated to process the corrugated encaustic metal sheet into encaustic metal tiles, and a cutting unit operated to cut the finished encaustic metal tiles to the desired size, said first shape forming mold unit comprised of an upper die holder, an upper die fixedly fastened to the upper die holder, a bottom die holder, a bottom die fixedly fastened to the bottom die holder, and hydraulic cylinders operated to reciprocate the upper die holder of said first shape forming mold unit vertically relative to the bottom die holder of said first shape forming mold unit, enabling the corrugated encaustic metal sheet to be stamped by the upper die and bottom die of said first shape forming mold unit, said second shape forming mold unit comprised of an upper die holder holding an upper die, a bottom die holder holding a bottom die, and hydraulic cylinders operated to reciprocate the upper die holder of said second shape forming mold unit vertically relative to the bottom die holder of said second shape forming mold unit, enabling the corrugated encaustic metal sheet to be stamped by the upper die and bottom die of said second shape forming mold unit, wherein said second shape forming mold unit is disposed adjacent to the first shape forming mold unit; a plurality of first auxiliary hydraulic cylinders are horizontally disposed below the bottom die holder of said first shape forming mold unit, each having a piston rod respectively connected to a horizontal slide, which carries said second shape forming mold unit for permitting said second shape forming mold unit to be moved horizontally with said horizontal slide relative to said first shape forming mold unit upon operation of said first auxiliary hydraulic cylinders; the hydraulic cylinders of said first shape forming mold unit are fixedly vertically fastened to the bottom die holder of said first shape forming mold unit at a bottom side, each having a piston rod fixedly connected to a transverse bar, which is connected in parallel to the upper die holder of said first shape forming mold unit by links, enabling the upper die holder of said first shape forming mold unit to be moved vertically upwards/downwards by operating the hydraulic cylinders of said first shape forming mold unit; said horizontal slide which carries said second shape forming mold unit comprises two sliding grooves longitudinally arranged in parallel at a bottom side wall thereof and coupled to two parallel rails at a top side of a base of the encaustic metal tile fabrication equipment, and is driven to move along said parallel rails by said first auxiliary hydraulic cylinders; the hydraulic cylinders of said second shape forming mold unit are respectively mounted on said horizontal slide, each having a vertically extended piston rod respectively connected to a horizontal bar, which is connected in parallel to the upper die holder of said second shape forming mold unit by links, enabling the upper die holder of said second shape forming mold unit to be moved vertically upwards/downwards by operating the hydraulic cylinders of said second shape forming mold unit; second auxiliary hydraulic cylinders are fixedly mounted on said horizontal slide at a bottom side, and operated to move the bottom die holder of said second shape forming mold unit vertically relative to the upper die holder of said second shape forming mold unit; the upper die of said first shape forming mold unit comprises a protruded rib raised along a vertical front side wall thereof at a bottom side; the bottom die of said second shape forming mold unit comprises a protruded rib raised along a vertical back side wall thereof at a top side.

* * * * *